US005540438A

United States Patent [19]

Horiuchi et al.

[11] Patent Number: 5,540,438

[45] Date of Patent: Jul. 30, 1996

[54] COATED GOLF BALL

[75] Inventors: Kuniyasu Horiuchi; Kiyoto Maruoka, both of Kobe, Japan

[73] Assignee: Sumitomo Rubber Industries, Ltd., Hyogo-ken, Japan

[21] Appl. No.: 231,297

[22] Filed: Apr. 22, 1994

[30] Foreign Application Priority Data

Apr. 22, 1993 [JP] Japan ..... 5-095781

[51] Int. Cl.[6] ..... A63B 37/12

[52] U.S. Cl. ..... 473/376; 473/377; 524/908

[58] Field of Search ..... 273/235 A, 235 R, 273/220; 524/908

[56] References Cited

U.S. PATENT DOCUMENTS 4,679,794 7/1987 Yamada ..... 273/235 R
4,679,795 7/1987 Melvin ..... 273/235 R
4,931,374 6/1990 Tomita et al. ..... 430/106
5,029,870 7/1991 Concepcion ..... 273/235 A

FOREIGN PATENT DOCUMENTS 0419079 3/1991 European Pat. Off. .

*Primary Examiner*—Irina Zemel
*Assistant Examiner*—I. Zemel
*Attorney, Agent, or Firm*—Birch, Stewart, Kolasch & Birch, LLP

[57] ABSTRACT

A coated golf ball comprising a core, a cover layer covering said core and a white paint layer coated on said cover wherein said cover is mainly composed of trans-polyisoprene, said paint layer comprises one or more white coating layers and clear coating layers, a white paint for forming said white paint layer contains 20 to 70% by weight of a white pigment and 0.005 to 0.10% by weight of a blue pigment based on a solid content of the white paint, and said blue pigment is selected from the group consisting of ∈-phthalocyanine blue and indanthrone blue.

2 Claims, No Drawings

COATED GOLF BALL

FIELD OF THE INVENTION

The present invention relates to a coated golf ball, that is, a golf ball which has its surface coated with a paint. More particularly, the present invention relates to a coated golf ball having a stable color tone and improved weathering properties.

BACKGROUND OF THE INVENTION

A golf ball covered with a balata cover is still popular because of its superior performance. A golf ball with a balata cover has poor whiteness in comparison with a golf ball covered with an ionomer resin cover, because the balata cover itself has a dark and dull color and even if coated with a white paint, its whiteness is insufficient.

In order to improve the whiteness of a golf ball with a balata cover, Japanese Kokai Publication Hei 4(1992)-500295 suggests to formulate a suitable amount of blue and violet pigments in the white paint. However, when two kinds of coloring pigments are formulated, it is necessary to control the amount of each pigment delicately. When the amount of one pigment becomes larger than that of the other one, the color tone of the resulting golf ball varies greatly, which results in a variability in the final products. Further, since two kinds of pigments are formulated, it takes a lot of time to disperse each pigment during the mixing process. Also, there is the problem that the balata cover becomes discolored due to weathering discoloration of the cover and paint.

SUMMARY OF THE INVENTION

Under these circumstances, in order to solve the above problem on the formulation of two kinds of pigments, the present inventors have worked diligently. As a result, the present invention has been completed. The main object of the present invention is to provide a coated golf ball in which the color tone is stabilized and the weathering properties are improved.

This object as well as other objects and advantages of the present invention will become apparent to those skilled in the art from the following description. That is, the present invention provides a coated golf ball comprising a core, a cover layer covering the core and a white paint layer coated on the cover wherein the cover is mainly composed of trans-polyisoprene. The white layer comprises one or more white coating layers and clear coating layers. The white paint for forming the white paint layer contains 20 to 70% by weight of a white pigment and 0.005 to 0.10% by weight of a blue pigment based on the solid content of the white paint, and the blue pigment is selected from the group consisting of ∈-phthalocyanine blue and indanthrone blue.

Particularly, the present invention provides an improvement of a golf ball covered with a balata cover.

DETAILED DESCRIPTION OF THE INVENTION

The golf ball of the present invention comprises a core and a cover covering the core. The core may be any one which has been used for golf balls, but generally is a thread wound core made by winding a rubber thread on a liquid center or a solid center. The cover of the present invention is mainly composed of trans-polyisoprene, i.e. the so-called "balata cover" which has been used for golf balls.

The white paint for coating the golf ball of the present invention generally comprises a main resin and a white pigment. The main resin can be any resin which has been used for golf balls, but generally includes an epoxy resin, an acrylic resin or urethane resin. The preferred main resin is a urethane resin. The amount of the main resin preferably is within the range of 20 to 80% by weight, based on the solid content of the white paint. The term "solid content" means the amount of solid components in the white paint from which liquid components are excluded.

The white paint contains a white pigment in an amount of 20 to 70% by weight based on a solid content of the white paint. The white pigment may be those which have hitherto been used for golf balls, and titanium oxide and barium sulfate are suitably used. When the amount of the white pigment is smaller than 20% by weight, the coating hiding power becomes inferior and, therefore, the desired white color cannot be obtained. When the amount exceeds 70% by weight, the physical properties of the coating become inferior. The amount is preferably 30 to 60% by weight.

In addition to the above components, various additives, curing catalysts and diluents are contained in the white paint. Examples of the additive include ultraviolet inhibitors, fluid agents, sealing pigments, fluorescent agents, fluorescent brighteners and the like. The amount of these additives is 0.1 to 10% by weight based on the solid content of the paint.

As the fluorescent agent or fluorescent brightener contained in the white paint, for example, there are those which are normally known and are used for the golf ball. Examples thereof include 2,5-bis[5'-t-butylbenzoxazolyl (2)]thiophene (commercially available from Japan Ciba Geigy Co. as Ubitex OB), 7-(2h-naphthol(1,2-d)-triazol-2-Y1 )-3-phenylcusline (commercially available from Sandz Co. as Leucopure EGM), biazoline derivative (commercially available from Morbey Chemical Corporation as Phorwhite K-2002), oxazoles (commercially available from Sumitomo Chemical Co., Ltd. as Whitefullar HCS, PCS, B), fluorescent brighteners (commercially available from Hoechst Japan Co. as Hostalux KCB) and the like. The amount thereof is 0.005 to 1.0% by weight based on the solid content of the paint.

Examples of the diluent formulated in the white paint include ketones such as acetone, methyl ethyl ketone, etc.; aromatic hydrocarbons such as toluene, xylene, etc.; esters such as ethyl acetate, etc. The amount of the diluent is not specifically limited, but preferably is 30 to 80% by weight based on the solid content of the white paint As the blue pigment which is a feature of the present invention, for example, ∈-phthalocyanine blue and indanthrone blue or a mixture thereof can be suitably used. The amount of the blue pigment is 0.005 to 0.1% by weight, preferably 0.01 to 0.07% by weight, based on the solid content of the white paint.

When the above specific blue pigment (i.e. ∈-phthalocyanine blue or indanthrone blue) is used, a golf ball wherein an L* value, an a* value and a b* value representing color tone are respectively 85 to 95, 0 to −2.5 and −5 to −9.5, and Wcie of 100 to 120 can be obtained using Lab and Wcie. When the values are not within the above ranges, the resulting golf ball with a balata cover lacks whiteness.

In the production of the coated golf ball of the present invention, the white paint containing the above blue pigment is applied on the body of the golf ball one or more times, and then a clear paint is applied thereon. The clear paint can be epoxy type, acrylic type or urethane type, but does not contain pigment. The clear paint is always known in connection with the production of the golf ball.

According to the present invention, the color tone of the golf ball after coating with paint can be controlled easily, and preferably, the whiteness can be obtained even by using the golf ball covered with a balata cover. Further, an excellent golf ball having little weathering discoloration can be obtained.

EXAMPLES

The following Examples and Comparative Examples further illustrate the present invention in detail but are not to be construed to limit the scope thereof.

Examples 1 to 5 and Comparative Examples 1 to 3

Paints A to G (Examples) and paints E to G (Comparative Examples) were prepared by mixing the components shown in Table 1 according to a conventional method.

TABLE 1

| | Example No. | | | | Comparative Example No. | | |
|---|---|---|---|---|---|---|---|
| | A | B | C | D | E | F | G |
| [Formulation] Resin to be used is urethane in all Examples and Comparative Examples (Amount: weight % based on the solids content of the coat) | | | | | | | |
| White pigment (titanium oxide) | 40 | 50 | 55 | 40 | 50 | 15 | 40 |
| Blue pigment (ε-Phthalocyanine blue) | 0.05 | 0.015 | | | | 0.05 | |
| Blue pigment (Indanthron blue) | | | 0.06 | 0.04 | | | |
| Blue pigment (α-Phthalocyanine blue) | | | | | 0.05 | | 0.05 |
| Violet pigment (Dioxazine) | | | | | 0.025 | | |

On the golf ball covered with a balata cover obtained by a conventional method, a white coat of two layers was formed using the above paint. Thereafter, color tone, feature of visual appearance, weathering discoloration, degree of visual discoloration, workability and variability of color tone were evaluated. The kind of the paint used and test results are shown in Table 2 below.

TABLE 2

| | Example No. | | | | | Comparative Example No. | | |
|---|---|---|---|---|---|---|---|---|
| | 1 | 2 | 3 | 4 | 5 | 1 | 2 | 3 |
| First layer | A | B | C | D | B | E | F | G |
| Second layer (Color tone) | A | B | C | D | C | E | F | G |
| L | 88 | 91 | 88 | 89 | 90 | 89 | 84 | 86 |
| a | −1.8 | −1.0 | −2.0 | −1.8 | −1.5 | −2.0 | −2.0 | −3.0 |
| b | −6.9 | −6.1 | −7.3 | −6.7 | −6.5 | −7.0 | −6.8 | −7.5 |
| Wcie | 111 | 107 | 117 | 110 | 109 | 112 | 90 | 113 |
| Feature of visual appearance | Good | Good | Good | Good | Good | Good | Dark and subdued whiteness | Dark and subdued whitensss |
| Weathering discoloration test (ΔE) | ⊚ | ⊚ | ⊚ | ⊚ | ⊚ | x | x | x |
| After 120 hours | 3.5 | 3.5 | 3.4 | 3.5 | 3.6 | 5.0 | 5.2 | 4.0 |
| Degree of visual discoloration | Medium | Medium | Medium | Medium | Medium | Large | Large | Medium to Large |
| Workability | Good | Good | Good | Good | Good | Long time is required for dispersion | Good | Good |
| Variability of color tone | Good | Good | Good | Good | Good | Variability is liable to be arisen | Good | Good |

Test Method (1) Measurement of color tone

Colorimeter CR221 manufactured by Minolta Co. (visual field of 2, 3 mmϕ, light source $D_{65}$), according to Y×y measurement The formula of whiteness degree of CIE●ISO:

$$Wcie = Y + 800\,(X_0 - X) + 1700\,(Y_0 - Y)$$

wherein $X_0$ and $Y_0$ are respectively chromaticity coordinate of perfect diffuser of $D_{65}$ lighting, $X_0$ is 0.3127 and $Y_0$ is 0.3291.

(2) Discoloration after weathering

After treating with a sunshine weather-o-meter for 120 hours, an L* value, an a* value and a b* value before and after treatment were measured by a colorimeter to determine ΔL*, Δa*, Δb* and ΔE. Evaluation was conducted according to the obtained data and visual observation.

(3) Workability

After mixing with a homomixer for one hour, the obtained mixture was allowed to stand for twenty-four hours. Thereafter, a dispersion state of the pigment was confirmed by visual observation.

Good: There is no problem about pigment dispersion.

What is claimed is:

1. A coated golf ball comprising a core, a cover layer covering said core and a white paint layer coated on said cover layer wherein said cover layer is primarily trans-polyisoprene, said paint layer comprising at least one white coating layer and at least one clear coating layer, said white paint layer containing 20 to 70% by weight of a white pigment and 0.005 to 0.10% by weight of a blue pigment based on the solid content of the white paint, and said blue pigment is selected from the group consisting of ∈-phthalocyanine blue and indanthrone blue.

2. The coated golf ball according to claim 1, wherein an L* value, an a* value and a b* value representing color tone are respectively 85 to 95, 0 to −2.5 and −5 to −9.5, and Wcie, representing whiteness, is 100 to 120.

* * * * *